United States Patent [19]

Fournier

[11] 4,204,362

[45] May 27, 1980

[54] BABY'S COMPANION AND SECURITY BLANKET

[76] Inventor: Herve L. Fournier, 95 Curtis Ave., South Attleboro, Mass. 02703

[21] Appl. No.: 936,634

[22] Filed: Aug. 24, 1978

[51] Int. Cl.[2] ..... A63H 3/36; A63H 3/46

[52] U.S. Cl. ..... 46/116; 46/164; 46/173; 46/32

[58] Field of Search ..... 46/116, 32, 151, 164, 46/173, 141

[56] References Cited

U.S. PATENT DOCUMENTS

| | | | |
|---|---|---|---|
| 683,857 | 10/1901 | Kilpatrick | 46/154 |
| 1,575,263 | 3/1926 | Guglielmi | 46/116 |
| 2,538,123 | 1/1951 | Price | 46/116 |
| 2,675,644 | 4/1954 | Senior et al. | 46/141 X |
| 3,308,479 | 3/1967 | Sesco | 46/116 X |
| 3,313,060 | 4/1967 | Mobley | 46/164 |

*Primary Examiner*—F. Barry Shay

*Attorney, Agent, or Firm*—Max Schwartz

[57] ABSTRACT

A baby's security blanket comprising a baby blanket approximately 30"×40" and a resilient rubber or synthetic doll's head mounted on the blanket. The head may be of a human figure or of an animal. The head is hollow and open at the neck. A sponge or similar compressible article is placed in the center of the blanket and pushed through the open neck into the head to fasten the blanket in the head. The sponge is of a larger diameter than the head opening so that it will expand after insertion to lock the head to the blanket. The draping blanket now forms a body for the head and serves as a security blanket. A large teething ring is mounted frictionally around the neck of the head. The teething ring is provided with an integral laterally extending portion having a slot opening. A baby pacifier is adapted to be pushed through the slot opening to mount the pacifier on the extension.

5 Claims, 5 Drawing Figures

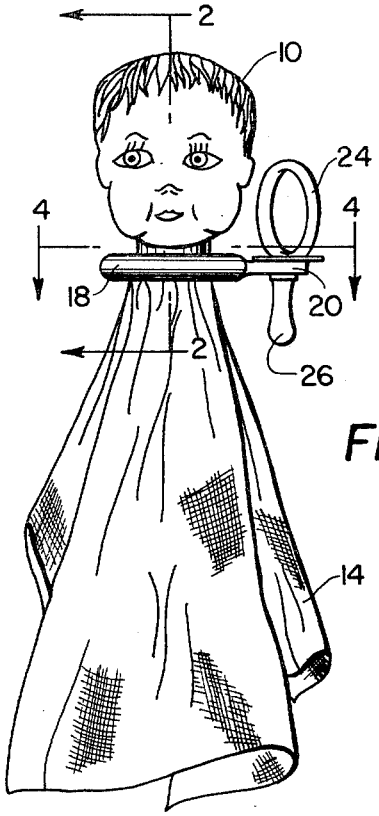
FIG. 1
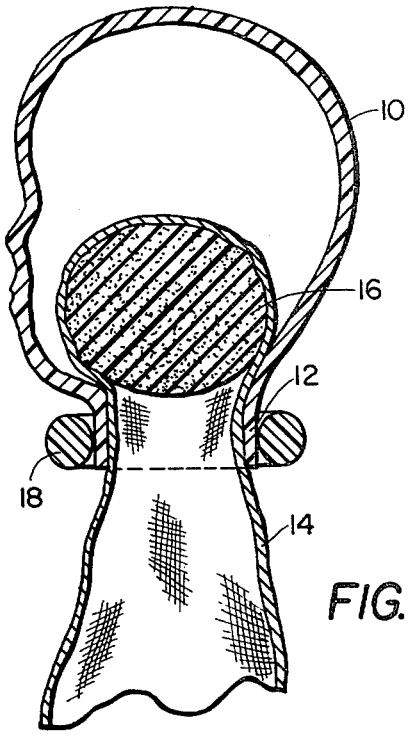
FIG. 2
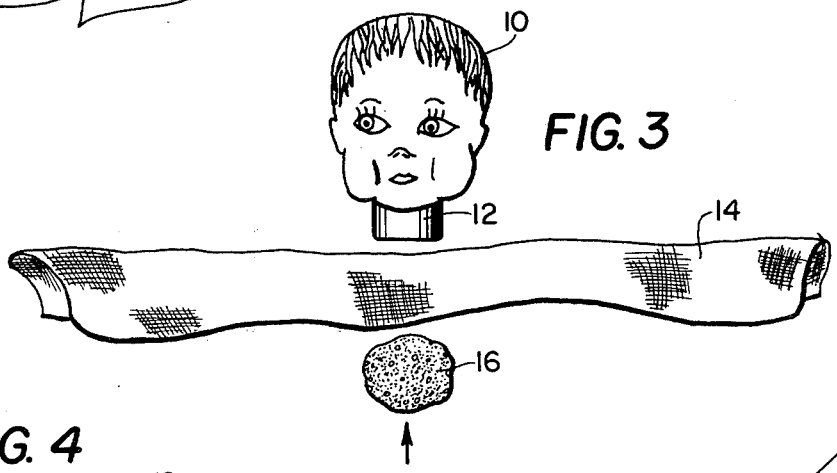
FIG. 3
FIG. 4
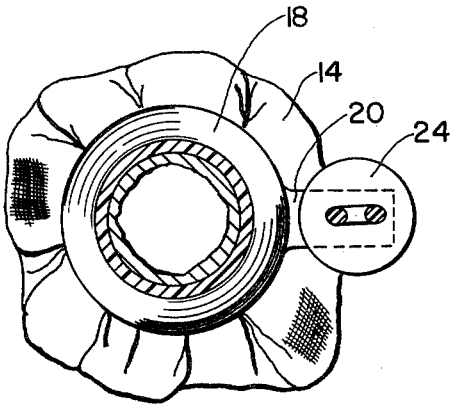
FIG. 5
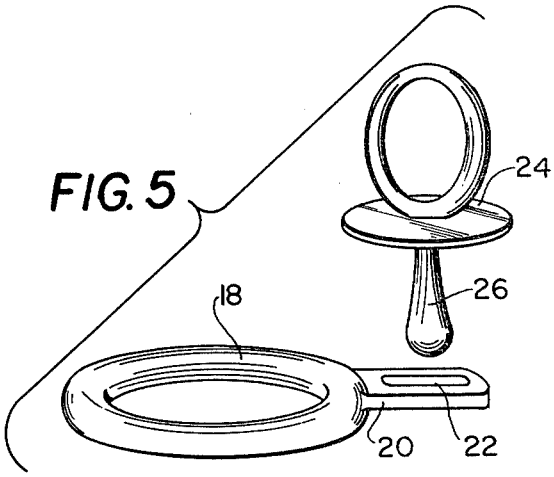

BABY'S COMPANION AND SECURITY BLANKET

BACKGROUND OF THE INVENTION

Small blankets, popularly known as security blankets, are highly desired by most babies. Babies also require teething rings and pacifiers. These items are usually separated and are often misplaced and lost. The art is devoid of any coordinated device which combines the necessary elements of a security blanket, teething ring and pacifier.

SUMMARY OF THE INVENTION

The present invention comprises a construction which uses a security blanket as a base and provides a combination security blanket and baby's companion. The blanket should be approximately 30"×40". A resilient rubber or plastic doll's head is provided which is hollow and has an open neck. A sponge having a diameter larger than the diameter of the open neck, is placed in the center of the blanket and pushed with the blanket through the neck opening. This will anchor the head to the blanket. A teething ring is frictionally mounted on the neck of the head and is large enough so that the baby can get to it. The teething ring is provided with an integral lateral extension having a slot opening. A baby pacifier is provided with the conventional nipple portion which can be pushed through the slot opening to mount the pacifier on the teething ring extension. This provides a unitary structure which combines a security blanket, teething ring and pacifier.

DESCRIPTION OF THE DRAWINGS

In the drawings:

FIG. 1 is a front elevation of a device embodying my present invention;

FIG. 2 is an enlarged section taken on line 2—2 on FIG. 1;

FIG. 3 is an exploded view showing the head and blanket assembly;

FIG. 4 is an enlarged section taken on line 4—4 on FIG. 1; and

FIG. 5 is a perspective view showing the teething ring and pacifier assembly.

DESCRIPTION OF THE INVENTION

Referring more in detail to the drawings, FIG. 3 shows the construction of the basic device. A doll's head 10 is provided with a neck portion 12 which is open at the bottom into the hollow head 10. The head is shown as a child's head for illustrative purposes and may be human or animal in form as desired. The head 10 should have a soft texture to the touch and can be molded of rubber or plastic.

The security blanket 14 is preferably approximately 30"×40". I now provide a sponge member 16 having a diameter somewhat larger than the inside diameter of the neck 12, see FIGS. 2 and 3. As can be seen in FIG. 3, the sponge 16 is placed in the center of the blanket 14 and pushed with the blanket through the neck opening 12 into the head. The sponge then expands to its size, FIG. 2, to lock the head 10 to the blanket. To clean the blanket, the sponge is compressible to remove the blanket from the head 10. Reassembly is simple.

To complete the device, I provide a teething ring 18 having an inside diameter adapted to frictionally tightly fit over the neck 12, FIG. 2. The teething ring 18 should be thick enough to allow the baby to gnaw or chew on it while it is in place.

The teething ring 18 is provided with an integral lateral extension 20 having a slot or opening 22. A baby pacifier 24 is provided with the conventional nipple portion 26. The nipple portion 26 is pushed through the opening or slot 22 to mount the nipple and pacifier on the teething ring extension 20. In this position, the baby can use the pacifier as mounted, or the mother can remove it from the extension to allow the baby to use it freely.

The entire assembly is accomplished without pins, nails, fasteners, or any other piece of equipment which may be dangerous to a baby. All the items are soft, flexible and non-toxic. The cost of assembly is comparatively small, there being little labor cost above the cost of the components. Cleaning and reassembly is also very easy.

Other advantages of the present invention will be readily apparent to a person skilled in the art.

I claim:

1. A baby's security blanket and companion comprising a rectangular baby blanket, a hollow toy figure head of a soft pliable material having a neck, said neck having an opening into said head, and means for mounting said head on said blanket, said means comprising a sponge having a diameter greater than the diameter of said neck opening, whereby said sponge, surrounded by a part of said blanket, can be pushed through said opening into said head to mount said head on said blanket.

2. A device as in claim 1, wherein a teething ring is mounted around said neck.

3. A device as in claim 2, wherein a baby pacifier is removably mounted on said teething ring.

4. A device as in claim 3, wherein said teething ring is provided with an integral lateral extension having an opening, said pacifier being mounted in said teething ring extension opening.

5. A device as in claim 1, wherein a baby pacifier is removably mounted on said head.

* * * * *